US006096979A

United States Patent [19]

Kyle

[11] Patent Number: 6,096,979

[45] Date of Patent: Aug. 1, 2000

[54] TERMINAL ASSEMBLY AND METHOD OF FORMING TERMINAL ASSEMBLY

[75] Inventor: James C. Kyle, Roseburg, Oreg.

[73] Assignee: Kyle Research Laboratories, Roseburg, Oreg.

[21] Appl. No.: 08/093,931

[22] Filed: Jul. 19, 1993

Related U.S. Application Data

[63] Continuation of application No. 07/509,910, Apr. 16, 1990, abandoned.

[51] Int. Cl.[7] ..... H01B 17/26

[52] U.S. Cl. ..... 174/152 GM; 174/50.61

[58] Field of Search ..... 174/152 GM, 50.58, 174/50.61, 50.63

[56] References Cited

U.S. PATENT DOCUMENTS

| | | | |
|---|---|---|---|
| 3,220,815 | 11/1965 | McMillan et al. | 174/152 GM X |
| 3,243,756 | 3/1966 | Ruete et al. | 174/73.1 X |
| 3,371,413 | 3/1968 | Rundle | 174/152 GM X |
| 4,421,947 | 12/1983 | Kyle | 174/152 GM |
| 4,493,378 | 1/1985 | Kyle | 174/152 GM |

*Primary Examiner*—Hyung-Sub Sough
*Attorney, Agent, or Firm*—Ellsworth R. Roston; Fulwider Patton Lee & Utecht, LLP

[57] ABSTRACT

A primarily polycrystalline but partially amorphous electrical insulator can hermetically seal first and second spaced electrical terminals, one made from an anodized aluminum and the second made from a beryllium copper, Kovar, an alloy of iron and cobalt or an alloy of beryllium, copper, nickel and gold. Nickel may be diffused into the beryllium copper and a noble metal may be deposited on the nickel. The insulator provides a flat meniscus to abut a corresponding electrical insulator in a cable. The insulator may provide an electrical impedance of approximately 50 ohms, an electrical resistivity greater than approximately $10^{18}$ ohms and a dielectric constant of approximately 6.3. The insulator operates satisfactorily in a frequency range to approximately 40 gigahertz. The insulator may be made from the following mixture:

| Material | Range of Relative Amounts by Weight |
|---|---|
| Red Lead (PbO) | 156–279 |
| Silicon Dioxide (Quartz) | 340 |
| Sodium Carbonate | 139–165 |
| Potassium Carbonate | 151–189 |
| Lithium Carbonate | 64–148 |
| Boric Acid | 111–183 |
| Calcined Alumina | 47–128 |

The mixture may be heated at about 400° F. for about 10 minutes, then at about 600° F. for about 60 minutes and then at about 1500° F. for about 120 minutes. The mixture may be stirred while being heated at about 600° F. and 1500° F. The mixture may then be quenched in water to form a frit. The frit may be disposed between the first and second terminals and the assembly may be formed by heating at about 200° F. for about 1 hour and then at about 1040° F. for about 40 minutes.

28 Claims, 1 Drawing Sheet

TERMINAL ASSEMBLY AND METHOD OF FORMING TERMINAL ASSEMBLY

This is a continuation of application Ser. No. 07/509,910 filed Apr. 16, 1990, now abandoned.

This invention relates to an assembly of electrical terminals and more particularly relates to an assembly of electrical terminals which are hermetically sealed to each other through the use of an electrical insulator having unique properties. The invention further relates to an electrical assembly in which the electrical terminals can be made from particular metals such as aluminum or beryllium copper. The invention also relates to the electrical insulator, the method of making the frit for the electrical insulator and the method of forming the assembly of electrical terminals.

BACKGROUND OF INVENTION

As the frequencies of electrical equipments have increased, the need to provide assemblies of electrical terminals (such as electrical connectors) at such frequencies has increased. For example, electrical equipments have been able to operate at frequencies in the tens of gigahertz and even higher. It has accordingly been recognized that electrical connectors should be able to operate in such frequency ranges in order to transfer electrical energy at such frequencies to and from such equipment and even to different stages in the equipment.

The electrical connectors generally include at least one electrically conductive terminal or pin for receiving the electrical energy in the operative range of frequencies and a sleeve or body spaced from the terminal for physically and electrically shielding the terminal. An electrical insulator is generally disposed between the terminal and the body and is hermetically sealed to the terminal or body.

Certain materials would be desirable for the terminal or pin and for the shield or body. For example, beryllium copper would be desirable for use as the terminal or pin because it conducts a large current per unit of cross-sectional area with minimal losses in energy. Aluminum would be desirable as the sleeve or body because it is light and is able to provide a good protection to the terminals or pins enveloped by the sleeve. Aluminum is also desirable because its skin anodizes in air and anodized aluminum provides an electrical insulation.

Although the desirable properties of such materials as beryllium copper and aluminum have been known for some time, it has been difficult to provide electrical insulators which will be capable of operating satisfactorily with such materials. This is particularly true when it is desired that the electrical connector have certain properties to make the electrical connector utilitarian. For example, it is often desired that the electrical connector provide an electrical impedance of approximately fifty (50) ohms between its terminals since this is generally the impedance that electrical equipments present to the outside world.

It is also desired that the electrical connector have other properties. For example, it is desired that the electrical connector have a relatively low dielectric constant in order to minimize the distributed capacitances in the connector. These distributed capacitances limit the range of frequencies in which the electrical connector is able to operate. By limiting the operative range of frequencies of the electrical connector, the distributed capacitances limit, as a practical matter, the range of frequencies in which the electrical equipment incorporating the electrical connector is able to operate.

It is also often desired that the electrical connector have other properties. For example, it is desired that the electrical insulator provide a high electrical resistivity through the operative range of frequencies in order to isolate electrically the terminals in the connector from one another and from the sleeve. It is also desired that the electrical insulator provide a flat meniscus so that the electrical insulation in a cable connected to the electrical connector will abut the electrical insulator in the connector. In this way, no air gap will be produced between the electrical insulator in the electrical connector and the electrical insulator in the cable to limit the range of frequencies in which electrical energy can pass effectively between the electrical connector and the cable.

Since it has been known for some time that an electrical connector with the properties discussed above would be desirable, attempts have been made over this period of time to provide an electrical connector with such properties. Since electrical connectors are common components in electrical equipment, such efforts have not been localized. In spite of such attempts, no one has been able to provide an electrical connector with the properties discussed above.

SUMMARY OF INVENTION

In one embodiment of the invention, a primarily polycrystalline but partially amorphous electrical insulator can hermetically seal first and second spaced electrical terminals, one made from an anodized aluminum and the second made from a beryllium copper, Kovar, an alloy of iron and cobalt. beryllium, copper, nickel and gold. Nickel may be diffused into the beryllium copper and a noble metal may be deposited on the nickel.

The insulator provides a flat meniscus to abut a corresponding electrical insulator in a cable. The insulator may provide an electrical impedance of approximately 50 ohms, an electrical resistivity greater than approximately $10^{18}$ ohms and a dielectric constant of approximately 6.3. The insulator operates satisfactorily in a frequency range to approximately 40 gigahertz.

The insulator may be made from the following mixture:

| Material | Range of Relative Amounts by Weight |
|---|---|
| Red Lead (PbO) | 156–279 |
| Silicon dioxide (Quartz) | 340 |
| Sodium Carbonate | 139–165 |
| Potassium Carbonate | 151–189 |
| Lithium Carbonate | 64–148 |
| Boric Acid | 111–183 |
| Calcined Alumina | 47–128 |

The mixture may be heated at about 400° F. for about 10 minutes, then at about 600° F. for about 60 minutes and then at about 1500° F. for about 120 minutes. The mixture may be stirred while being heated at about 600° F. and 1500° F. The mixture may then be quenched in water to form a frit. The frit may be disposed between the first and second terminals and the assembly may be formed by heating at about 200° F. for about 1 hour and then at about 1040° F. for about 40 minutes.

DETAILED DESCRIPTION OF INVENTION

Figure 1:
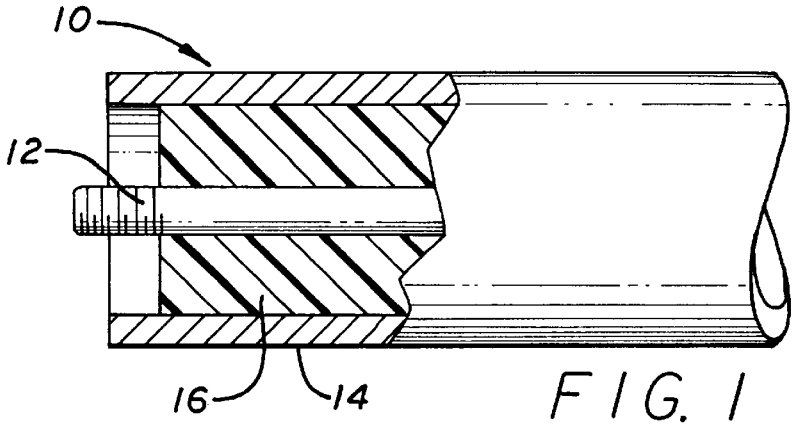
FIG. 1 schematically illustrates an electrical assembly, such a n electrical connector, constituting one embodiment of the invention.

In one embodiment of the invention, an electrical connector generally indicated at 10 is shown. The electrical connector 10 includes an electrical terminal or pin 12 and a sleeve or body 14. The terminal 12 may be disposed at the radial center and the sleeve 14 may be annular and may be disposed in concentric relationship with the terminal. An electrical insulator 16 may be disposed between the terminal 12 and the sleeve 14 and may be hermetically sealed to the terminal and the sleeve. The electrical insulator 16 may be primarily polycrystalline but partially amorphous.

The terminal 12 may be preferably made from a material selected from the group consisting of beryllium copper, Kovar (which is an alloy of iron and nickel) and an alloy of iron and cobalt. Beryllium copper is desirable for use as the terminal 12 because it has certain desirable properties. For example, it is very strong and it is non-corrosive. Furthermore, it doesn't rust. It conducts approximately eight (8) times the current per unit area that alloys of copper and nickel conduct. The beryllium copper may be coated with a nickel which is absorbed or diffused into the copper as by heating. A thin layer of a noble metal such as rhodium may then be coated onto the nickel. Rhodium is desirable because it is a good electrical conductor and is non-corrosive. It provides a good electrical continuity with an electrical lead connected to the terminal 12. Alternatively, an alloy of a mixture containing beryllium, copper, nickel and gold may be used as the terminal 12. Such an alloy is commercially available.

The sleeve 14 may be made from a suitable material such as aluminum. Aluminum is desirable because it is light and commercially available at low prices. The external skin of the aluminum is anodized to convert the skin to aluminum oxide. Although aluminum is a good electrical conductor, aluminum oxide is an electrical insulator. In this way, the skin of the sleeve 14 provides a barrier against the flow of electrical current through the sleeve.

The electrical insulator 16 may be made from a mixture of the following materials in the following range of relative amounts by weight:

| Material | Range of Relative Amounts by Weight |
|---|---|
| Red Lead (PbO) | 156–279 |
| Silicon dioxide (Quartz) | 340 |
| Sodium Carbonate | 139–165 |
| Potassium Carbonate | 151–189 |
| Lithium Carbonate | 64–148 |
| Boric Acid | 111–183 |
| Calcined Alumina | 47–128 |

Preferably the electrical insulator 16 includes a mixture of the following materials in the following relative amounts by weight:

| Material | Range of Relative Amounts by Weight |
|---|---|
| Red Lead (PbO) | 156 |
| Silicon dioxide (Quartz) | 340 |
| Sodium Carbonate | 139 |
| Potassium Carbonate | 189 |
| Lithium Carbonate | 148 |
| Boric Acid | 183 |
| Calcined Alumina | 128 |

Beryllium copper has a coefficient of thermal expansion of $12\times10^{-18}$ in/in/°F. Aluminum has a coefficient of thermal expansion of $22\times10^{-18}$ in/in/°F. The electrical insulator 16 has a coefficient of thermal expansion of approximately $20\times10^{-18}$ in/in/°F. As will be seen, the coefficient of thermal expansion of the electrical insulator 16 is between the coefficients of thermal expansion of beryllium copper when used as the terminal 12 and aluminum when used as the sleeve 14. Furthermore, the coefficient of thermal expansion of the electrical insulator 16 is relatively close to the coefficient of thermal expansion of aluminum. This causes the electrical insulator 16 to impart strength to the sleeve 14 without pushing outwardly on the sleeve with changes in temperature.

Because of the relative coefficients of thermal expansion of the different materials in the electrical assembly 10, the electrical connector is able to operate through a range of temperatures between about −35° C. to +120° C. with the electrical insulator maintaining an optimal hermetic seal to the electrical terminal 12 and the sleeve 14.

Each of the different materials specified above provides an individual contribution to the properties of the electrical insulator 16. The read lead (PbO) forms a glassy flux having a relatively low melting temperature and tends to make the electrical insulator 16 partially amorphous. The silicon dioxide, sodium carbonate and potassium carbonate also tend to form a glassy flux having a relatively low melting temperature and also tend to make the electrical insulator 16 partially amorphous. The use of quartz as the silicon oxide in the electrical insulator 16 is preferable to the use of other forms of silicon dioxide (such as sand) in the insulator.

The lithium carbonate contributes to the coefficient of thermal expansion of the electrical insulator 16 in providing the insulator with a coefficient which is less than, but close to, the coefficient of thermal expansion of the sleeve 14 so that the insulator does not push outwardly against the sleeve with changes in temperature. The lithium carbonate and the calcined alumina form nucleosites which serve as the seeds for the formation of the polycrystals in the electrical insulator 16. The boric acid facilitates the bonding of the insulator to aluminum and also contributes to the coefficient of thermal expansion of the insulator 16.

The mixtures discussed above provide a dielectric constant in the range of approximately 6.3–6.7 in the assembly 10. As the dielectric constant increases, the distributed capacitances between the terminal 12 and the sleeve 14 increase. It will be appreciated that, if there is more than one terminal in the assembly, the distributed capacitances will exist between each terminal and the sleeve and between the different terminals. These distributed apacitances are not desirable because they limit the frequency range in which the assembly 10 can operate. The preferred embodiment has a dielectric constant such as approximately six and three tenths (6.3). With this dielectric constant, the assembly 10 operates satisfactorily through a frequency range from DC to approximately forty gigahertz (40 gHz).

The assembly 10 also has other advantageous parameters. For example, the assembly provides an output impedance of approximately fifty (50) ohms. This is important in matching the input impedance of components to which the assembly 10 may be connected. For example, when the assembly 10 constitutes an electrical connector, it is generally connected to a cable (not shown) which introduces signals, voltages or currents to other stages in complex electrical equipment. Such cables generally have impedances of approximately fifty (50) ohms. By matching the impedance of the assembly 10 to the impedance of the cable, an optimal transfer of signals may be provided between the assembly and the cable with minimal power losses.

The are also other important advantageous parameters in the assembly 10. For example, the electrical resistivity of and the surface resistance of the electrical insulator 16 are also quite high. For example, the electrical resistance of the insulator 16 is approximately $10^{18}$ ohms. The resistance of the electrical insulator 16 to acids and alkalis is also quite high. By way of illustration, when units of the assembly 10 were dipped in an alkali for approximately twenty four (24) hours, there was no loss of material in the electrical insulator 16. As another example, the electrical insulator 16 was dipped in a five percent (5%) solution of hydrochloric acid for about one (1) hour. At the end of that period of time, there was only approximately an eighteen percent (18%) loss in the weight of the electrical insulator 16.

Figure 2:
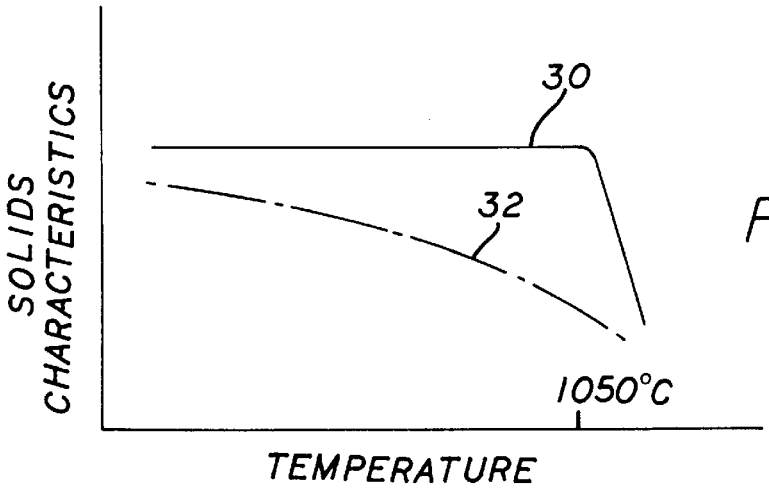
FIG. 2 is a curve schematically illustrating how an electrical insulator in the electrical assembly retains its solid characteristics over an extended range of temperatures.

The electrical insulator 16 also has another parameter of distinctive importance. As illustrated in FIG. 2 at 20, the liquidus—solidus characteristic of the insulator 16 remains substantially constant through a range of temperatures to approximately 1050° C. At a temperature of approximately 1050° C., the electrical insulator 16 changes abruptly from a completely solid state to a melted state. This may be seen at 30 in FIG. 2. This is advantageous compared to electrical insulators of the prior art since it allows the terminal 12 to be held firmly in place until a temperature in excess of 1000° C.

In the prior art, the solidus—liquidus characteristic tends to decrease progressively for progressive increases in temperature above a relatively low value. This is indicated at 32 in FIG. 2. This means that the electrical insulators of the prior art tend to change progressively from a solid state to a melted (or liquid) state with progressive increases in temperature above the relatively low value. This causes the different parameters (e.g. dielectric constant, electrical resistivity, surface resistivity) of the electrical insulators of the prior art to change with progressive increases in temperature above the relatively low value. It also causes the electrical terminals in the electrical connectors of the prior art to become progressively loosened in the connectors.

Figure 3:
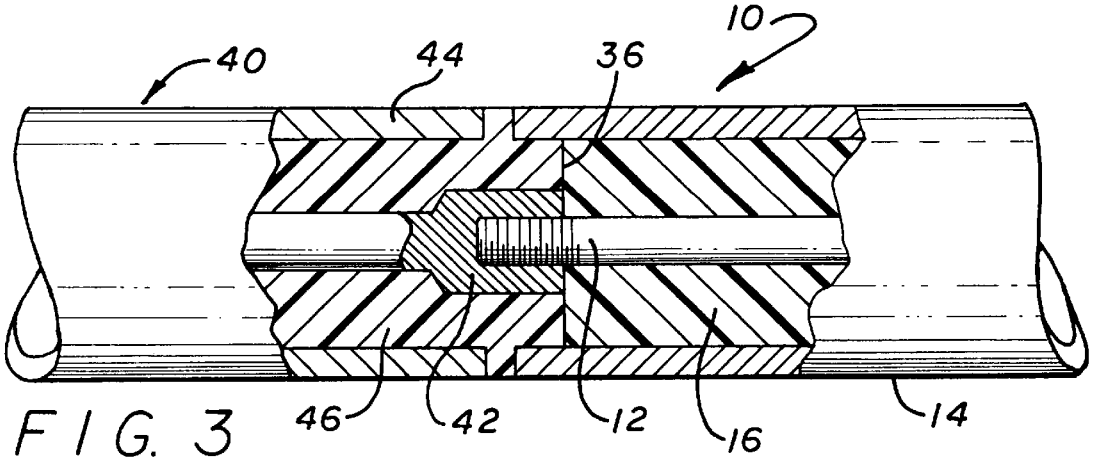
FIG. 3 schematically illustrates an electrically coupled relationship between the assembly of FIG. 1 and an electrical cable and further illustrates how the electrical insulators between such assembly and such cable form a tight dielectric bond.

The electrical insulator 16 is also advantageous in that it provides a flat meniscus 36 as shown schematically in FIG. 3. This is advantageous when the assembly 10 is used as an electrical connector which is coupled to a cable generally indicated at 40. The cable 40 has a centrally disposed terminal 42, a sleeve 44 and an electrical insulator 46. The terminal 42 may have a female configuration to be press fit on the terminal 12 and the sleeve 44 may be internally threaded to screw on external threads on the insulator 14.

By providing the electrical insulator 16 with the flat meniscus 36, the electrical insulator 16 can be disposed in flat and abutting relationship with the electrical insulator 46 in the cable 40. This prevents any electrical or dielectric discontinuities from being produced between the electrical insulators 16 and 46. Such discontinuities are disadvantageous since they tend to produce impedance mismatches between the assembly 10 and the cable 40, particularly at elevated frequencies, and tend to limit the frequency range in which the electrical assembly 10 and the cable 40 can operate affectively.

The electrical insulator 16 also has other properties which impart distinctive advantages to the electrical assembly 10. If the electrical terminal 12 or the sleeve 14 should be bent, the electrical insulator will crack but it won't spall. This tends to preserve the electrical characteristics of the electrical assembly 10 more effectively than if the electrical insulator 16 spalled.

A frit is initially made of the material constituting the electrical insulator 16. To produce the frit, the different materials specified above are mixed in the relative amounts specified above. It should be noted that it is desirable that quartz be used as the source of silicon dioxide rather than sand or flint since quartz has a different coefficient of thermal expansion than sand or flint. It is also desirable that the calcined alumina be initially heated to a temperature such as about 200° F. for a suitable period of time such as about four (4) hours to remove all water from the alumina. It is also desirable that the calcined alumina have a mesh such as approximately 1000 and that the other materials in the mixture be in the form of small particles.

As a first step, the mixture of the materials constituting the electrical insulator 16 may be heated to a suitable temperature such as approximately 400° F. for a suitable period such as approximately ten (10) minutes. This heating preferably occurs in air rather than in a vacuum. The mixture may then be heated to a suitable temperature such as approximately 600° F. for a suitable period of time such as approximately sixty (60) minutes. This heating preferably occurs in air rather than in a vacuum. During this period of time, gases such as carbon dioxide tend to escape from the mixture. These gases create bubbles and tend to swell the mixture. The mixture should accordingly be stirred to provide for an escape of such gas bubbles. Because of the increase in the volume of the mixture during this period, the volume of the mixture in the crucible should be relatively small compared to the volume of the crucible. For example, the volume of the mixture may be approximately one fourth (¼) of the volume of the crucible.

The mixture is then heated rapidly from a temperature of approximately 600° F. to a suitable temperature such as approximately 1500° F. This heating preferably occurs in air rather than in a vacuum. Preferably this occurs in a relatively short period of time such as approximately ten (10) minutes. The mixture is then maintained at this temperature of approximately 1500° F. for a suitable period of time such as approximately two (2) hours. During this period of time, the mixture should be occasionally mixed to provide for the escape of the gases such as carbon dioxide. The mixing should continue until all of the gases have been formed and have been allowed to escape and until the mixture starts to assume a glossy state. After the mixture has been heated as described above, it is quenched in water and is ground to form small beads or pellets.

When the terminal 12 is made from a beryllium copper, it is preferably coated initially with a layer of nickel. The nickel coating preferably occurs in a Wattless Shipley bath having two (2) components. One (1) component constitutes a Duro Posit #84M bath and the other component constitutes a Duro Posit #R bath. Both of these components are commercially available. The first component preferably constitutes seventy five percent (75%) of the bath and the second component preferably constitutes twenty five percent (25%) of the bath. A fresh bath is preferably formed every time that terminals 12 are to be coated with nickel.

The terminals 12 are disposed for a suitable period such as approximately five (5) minutes in the bath specified above, which is preferably at a suitable temperature such as approximately 225° F. Approximately twenty microinches of nickel may be deposited on the berrylium copper in this period of time. The terminals 12 are then removed from the bath and are dried completely at a suitable temperature such as approximately 140° F. The nickel coating on the terminals 10 are then preferably diffused into the beryllium copper by subjecting the terminals to a suitable temperature such as approximately 110° F. for a suitable time such as approximately ten (10) minutes. In this way, a tenacious bond is provided between the beryllium copper and the nickel. A noble metal such as rhodium may then be deposited on the terminal 12 in a conventional manner. The rhodium has a tenacious bond to the nickel.

The terminal 12 has certain important advantages when it is made from beryllium copper with nickel diffused into the beryllium copper and rhodium deposited on the nickel. As previously described, it conducts currents considerably larger per unit area than other materials such as a copper nickel alloy. The terminal 12 is also strong, non-corrosive and non-magnetic and does not rust.

The sleeve 14 may preferably constitute a 2219 alloy or a 6061 alloy sold by the Aluminum Company of America. The sleeve 14 may be pre-anodized as by conventional techniques before the assembly 10 is formed. The beads of the frit forming the electrical insulator 16 may then be disposed between the terminal 12 and the sleeve 16 to form the assembly 10. The terminal 12 does not have to be masked, as in the prior art, at positions adjacent the electrical insulator 16 because the material of the terminal 12 is non-corrosive.

The assembly 10 is then heated to a suitable temperature such as approximately 400° F. for a suitable period such as approximately one half (½) of an hour. During this time any water in the assembly, and particularly on the surface of the sleeve 14, is removed from the assembly 10. The assembly 10 is then heated to a suitable temperature such as approximately 1100° F. for a suitable period of time such as approximately twenty (20) minutes to cure the electrical insulator 16 and to bond the insulator hermetically to the terminal 12 and the sleeve 14.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination, a first electrical terminal having a first coefficient of thermal expansion, a second electrical terminal spaced from the first electrical terminal and made from aluminum and having a second coefficient of thermal expansion different from the first coefficient of thermal expansion, and an electrical insulator having partially amorphous and partially polycrystalline properties and disposed between the first and second terminals and hermetically sealing the first and second electrical terminals and having a third coefficient of thermal expansion between the first and second coefficients of thermal expansion.

2. In a combination as set forth in claim 1, the first electrical terminal being made from a material selected from the group consisting of a beryllium copper alloy, Kovar, an alloy of iron and cobalt and an alloy of beryllium, copper, nickel and gold.

3. In a combination as set forth in claim 1, the electrical insulator providing approximately $10^{18}$ ohms of electrical resistivity and having properties of maintaining electrical insulation in a range to approximately forty (40) gigahertz.

4. In a combination as set forth in claim 1, the electrical insulator having properties of providing a substantially constant solidus-liquidus characteristic to a temperature in excess of approximately 1000° F.

5. In a combination as recited in claim 1, the electrical insulator having a dielectric constant of approximately 6.3 to minimize the distributed capacitance in the combination.

6. In combination, a first electrical terminal having a first coefficient of thermal expansion, a second electrical terminal spaced from the first electrical terminal and having a second coefficient of thermal expansion different from the first coefficient of thermal expansion, the second electrical terminal being made from aluminum, an electrical insulator disposed between the first and second electrical terminals and hermetically sealed to the first and second electrical terminals and having a third coefficient of thermal expansion between the first and second coefficients of thermal expansion but approaching the second coefficient of thermal expansion to maintain the hermetic seal to the first and second electrical terminals through a range of temperatures in excess of approximately 1000° F.

7. In a combination as set forth in claim 6, the first electrical terminal being made from a material selected from the group constituting of a beryllium copper alloy, Kovar, an alloy of iron and cobalt and an alloy of beryllium, copper, nickel and gold.

8. In a combination as set forth in claim 7, the first electrical terminal being formed from the beryllium copper alloy and nickel being diffused in a thin layer into the beryllium copper alloy and a noble metal being deposited on the nickel.

9. In a combination as set forth in claim 6, the electrical insulator having approximately $10^{18}$ ohms of electrical resistivity and having properties of maintaining electrical insulation between the first and second electrical terminals in a range to approximately forty (40) gigahertz.

10. In a combination as set forth in claim 6, the electrical insulator having flat external surfaces in the space between the first and second electrical terminals to provide for a flat disposition of the electrical insulator against an electrical insulator in a cable attached to the first and second electrical terminals.

11. In a combination as set forth in claim 6, the electrical insulator having a dielectric constant of about 6.3 and providing a substantially constant solidus-liquidus value to a temperature in excess of approximately 1000° F.

12. In combination, a first electrical terminal, a second electrical terminal spaced from the first electrical terminal, and an electrical insulator disposed between the first and second terminals and hermetically sealed to the first and second terminals and made from a material including the oxides of lead, silicon, sodium, potassium, lithium, aluminum and boron.

13. In a combination as set forth in claim 12 wherein the electrical insulator is primarily polycrystalline but is partially amorphous and the electrical insulator has a dielectric constant to minimize any distributed capacitances between the first and second electrical terminals without significantly affecting the electrical resistivity between the first and second electrical terminals.

14. In a combination as set forth in claim 13 wherein the electrical insulator has a flat meniscus to minimize a discontinuity of dielectric constants resulting from air gaps when the first and second electrical terminals are attached to corresponding terminals in an electrical cable having a dielectric material between such corresponding terminals.

15. In a combination as set forth in claim 12 wherein the first electrical terminal is made from a material selected from the group consisting of a beryllium copper alloy, Kovar, an alloy of iron and cobalt and an alloy of beryllium, copper, nickel and gold and the second electrical connector is made from anodized aluminum.

16. In combination, a first electrical terminal having a first coefficient of thermal expansion, a second electrical terminal having a second coefficient of thermal expansion different from the first coefficient of thermal expansion, the second electrical terminal being made from aluminum, and an electrical insulator made from a partially amorphous and partially polycrystalline material having a dielectric constant of approximately 6.3 and an electrical resistivity of at least $10^{18}$ ohms and having properties of insulating the first electrical terminal from the second electrical terminal to frequencies of approximately forty gigahertz (40 Ghz), the electrical insulator hermetically sealing the first and second electrical terminals.

17. In a combination as set forth in claim 16, the electrical insulator being impervious to alkalis and acids.

18. In a combination as set forth in claim 17, the first electrical terminal being made from a material selected from the group consisting of a beryllium copper alloy, Kovar, an alloy of iron and cobalt and an alloy of beryllium, copper, nickel and gold.

19. In a combination as set forth in claim 18 the electrical insulator providing a flat meniscus to abut an electrical insulator in a cable without any spacing between the electrical insulators.

20. In combination, a first electrical terminal having a first coefficient of thermal expansion, a second electrical terminal made from aluminum and having a second coefficient of thermal expansion different from the first coefficient of thermal expansion, and a ceramic insulating material hermetically sealing the first and second electrical terminals and having a third coefficient of thermal expansion close to the second coefficient of thermal expansion but between the first and second coefficients of thermal expansion and cooperating with the first and second electrical terminals to provide an impedance of approximately fifty (50) ohms between the electrical terminals.

21. In a combination as set forth in claim 20, the ceramic insulating material being primarily polycrystalline but partially amorphous.

22. In a combination as set forth in claim 21, the first electrical terminal being made from a material selected from the group consisting of a beryllium copper alloy, Kovar, an alloy of iron and cobalt and an alloy of beryllium, copper, nickel and gold.

23. In a combination as set forth in claim 22, the ceramic insulating material having a flat meniscus to abut an insulating member in a cable without any air pockets between the ceramic insulating member and the insulating member in the cable.

24. In combination, a first electrical terminal having a first coefficient of thermal expansion, the first electrical terminal being made from a material selected from the group consisting of a beryllium copper alloy, Kovar, an alloy of iron and cobalt and an alloy of beryllium, copper, nickel and gold, a second electrical terminal having a second coefficient of thermal expansion different from the first coefficient of thermal expansion, and an electrical insulator disposed between the first and second electrical terminal and hermetically sealed to the first and second electrical terminals end being primarily polycrystalline but partially amorphous.

25. In a combination as set forth in claim 24, nickel being diffused into the beryllium copper in the first electrical terminal and a noble metal being deposited on the nickel in the first electrical terminal.

26. In a combination as set forth in claim 24, the electrical insulator having a flat meniscus between the first and second terminals and providing a substantially constant solidus-liquidus characteristic to a temperature in excess of approximately 1000° F.

27. In a combination as set forth in claim 24, the second electrical terminal being made from an anodized aluminum.

28. In a combination as set forth in claim 25, the second electrical terminal being made from an anodized aluminum.

* * * * *